US005287991A

United States Patent [19]

Koda et al.

[11] Patent Number: 5,287,991

[45] Date of Patent: Feb. 22, 1994

[54] LAUNDRY BASKET AND HANDLE ASSEMBLY THEREFOR

[75] Inventors: Walter P. Koda, Brookfield, N.H.; Paul Santarsiero, Avon, Conn.; William Seabolt, Copley; Walter H. Wilsford, Shreve, both of Ohio

[73] Assignee: Mobil Oil Corporation, Fairfax, Va.

[21] Appl. No.: 930,111

[22] Filed: Aug. 14, 1992

Related U.S. Application Data

[63] Continuation-in-part of Ser. No. 920,945, Jul. 28, 1992, which is a continuation-in-part of Ser. No. 606,213, Oct. 31, 1990 U.S. Pat. No. 5,133,472.

[51] Int. Cl.[5] ..... B65D 25/00

[52] U.S. Cl. ..... 220/769; 220/643; 220/770

[58] Field of Search ..... 220/759, 768, 769, 770, 220/643

[56] References Cited

U.S. PATENT DOCUMENTS

| | | | |
|---|---|---|---|
| 2,146,415 | 2/1939 | Bradley | 220/95 |
| 2,191,291 | 2/1940 | Smith | 229/52 |
| 2,371,639 | 3/1945 | Mason | 16/125 |
| 2,555,926 | 6/1951 | Hendrick | 220/94 |
| 3,419,182 | 12/1968 | Gildart | 220/73 |
| 5,133,472 | 7/1992 | Koda et al. | 220/769 |

*Primary Examiner*—Steven M. Pollard

*Attorney, Agent, or Firm*—Alexander J. McKillop; George W. Hager, Jr.; Michael J. Mlotkowski

[57] ABSTRACT

A laundry basket and a handle assembly therefor are disclosed. The laundry basket includes a walled container having a peripheral rim about a substantial portion thereof, a pair of opposing hand openings adjacent the peripheral rim, and a pair of handle members extending, respectively, about the rim and through the hand openings, each of the handle members including a bottom portion positioned below the rim, the bottom portion defining an upper boundary of one of the hand openings and a top portion, the top portion being connected to the bottom portion, wherein one of the top or bottom portions of each of the handle members is integral to the peripheral rim. Each portion of the handle members preferably includes a curved exterior surface to facilitate the lifting and carrying of the basket.

13 Claims, 8 Drawing Sheets 38
64
36A
6
40
54
92
6
16
32
30
28
26
22
24
7
68
66
10
14
70
7
36B
74
84
72
70
68

LAUNDRY BASKET AND HANDLE ASSEMBLY THEREFOR

RELATED APPLICATIONS

This application is a continuation-in-part of copending application Ser. No. 07/920,945, filed on Jul. 28, 1992, which is a continuation-in-part of copending application Ser. No. 07/606,213, filed on Oct. 31, 1990 U.S. Pat. No. 5,133,472.

FIELD OF THE INVENTION

The field of the invention relates to laundry baskets of the type including peripheral rims, and handles for allowing such baskets and the like to be carried.

BACKGROUND OF THE INVENTION

Rimmed containers such as laundry baskets are frequently provided with integrally formed handle portions to facilitate lifting or carrying them. Such baskets are often molded from a polymeric material into any of the basic basket shapes (e.g. round, rectangular or elliptical). The handle portions are formed in opposing sides of the basket.

The integral, molded handles provided with conventional molded laundry baskets and the like provide little more than a narrow rim or lip for the user to grasp. Such narrow rims usually allow no more than finger tip support from human hands. Such support results in the user's knuckles being extended relatively far beyond the ends of the basket where they are vulnerable to bumping against door frames and other objects. Even more importantly, the edges of the handle may cut or hurt the user's hands.

A further disadvantage of conventional, integrally molded laundry basket handles is their tendency to break or tear. Since the baskets may often contain relatively heavy loads, such breakage can render the basket essentially useless.

SUMMARY OF THE INVENTION

It is an object of the invention to provide a laundry basket which may be comfortably gripped by a user.

It is another object of the invention to provide a laundry basket which is relatively durable and safe to use.

A still further object of the invention is to provide a laundry basket which is aesthetically appealing.

A still further object of the invention is to provide a handle assembly which may be assembled to rimmed containers such as laundry baskets to facilitate lifting and carrying thereof.

In accordance with these and other objects of the invention, a laundry basket is provided which comprises a walled container having a peripheral rim and a pair of opposing hand openings adjacent the rim. A pair of handle members extend, respectively, about the rim and through the respective hand openings. The handle members each preferably include interlocked top and bottom portions which are positioned above and below the rim. Each bottom portion preferably includes a curved exterior surface which defines an upper boundary of one of the hand openings.

The peripheral rim of the laundry basket is preferably formed by a generally horizontal portion and a downwardly extending portion. The downwardly extending portion is in opposing relation to the exterior surfaces of the walls of the basket. The bottom portions of the handle members are at least partially positioned between the downwardly extending portion of the rim and the exterior surfaces of the basket. The bottom portion may further include an elongated slot which accepts either the downwardly extending rim portion or a portion of the basket wall above a hand opening.

A handle assembly is also provided for securement to a rimmed container such as a laundry basket. The handle assembly includes a bottom portion having an elongate and at least generally semicylindrical body. The body includes an elongate slot which is capable of receiving a wall or rim portion of a container. The assembly further includes a top portion having an elongate and at least generally cylindrical body. Means are provided for locking the top portion to the bottom portion. The locking means preferably include a male locking member extending from the top portion of the handle assembly and a female locking member formed by the bottom portion thereof.

Still in accordance with the present invention, another embodiment of a laundry basket is provided. This embodiment comprises a walled container having a peripheral rim about a substantial portion thereof, a pair of opposing hand openings adjacent the peripheral rim, and a pair of handle members extending, respectively, about the rim and through the hand openings, each of the handle members including a bottom portion positioned below the rim, the bottom portion defining an upper boundary of one of the hand openings and a top portion, the top portion being connected to the bottom portion, wherein one of the top or bottom portions of each of the handle members is integral to the peripheral rim.

Also, a handle assembly for a rimmed container such as a laundry basket or the like is provided, this handle assembly being particularly preferred from the standpoint of manufacturing economics. The handle assembly is comprised of a bottom portion integral to the rimmed container having an elongate, at least generally semicylindrical body having a longitudinal axis, a top portion having an elongate, at least generally semicylindrical body, and interlocking means for locking the top portion to the integral bottom portion, wherein the top portion is configured to engage the bottom portion of the handle assembly.

DETAILED DESCRIPTION OF THE INVENTION

Figure 1:
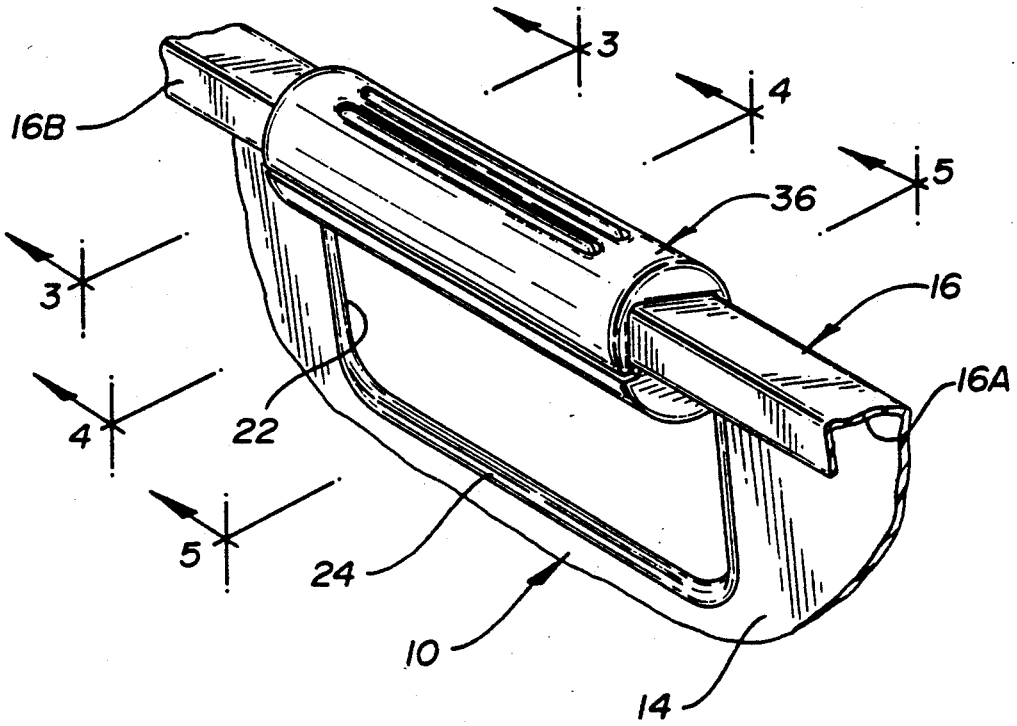
FIG. 1 is a perspective view of a wall and rim of a laundry basket including a handle according to the invention.
Figure 10:
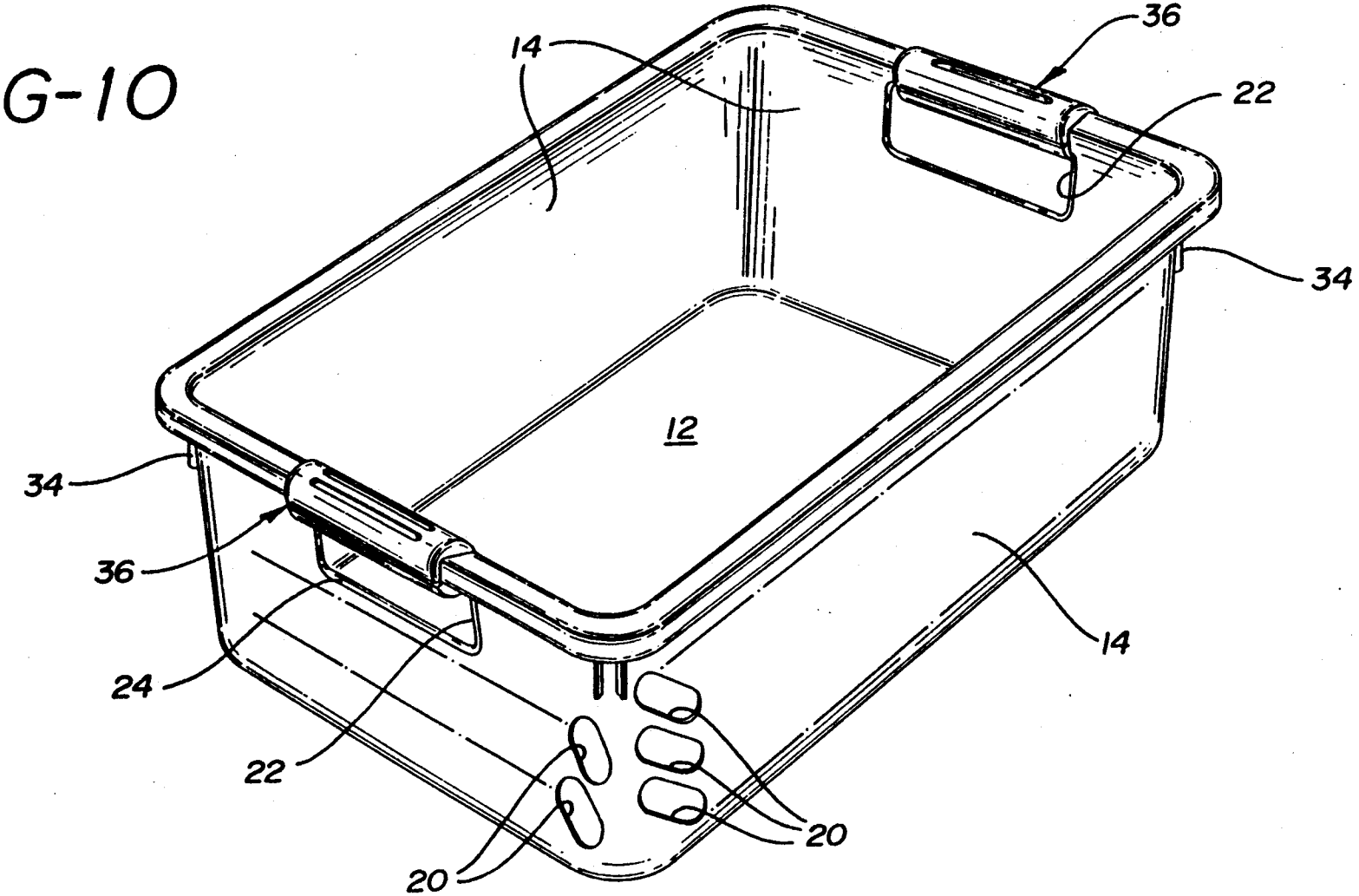
FIG. 10 is a top perspective view of a laundry basket in accordance with the invention.
Figure 11:
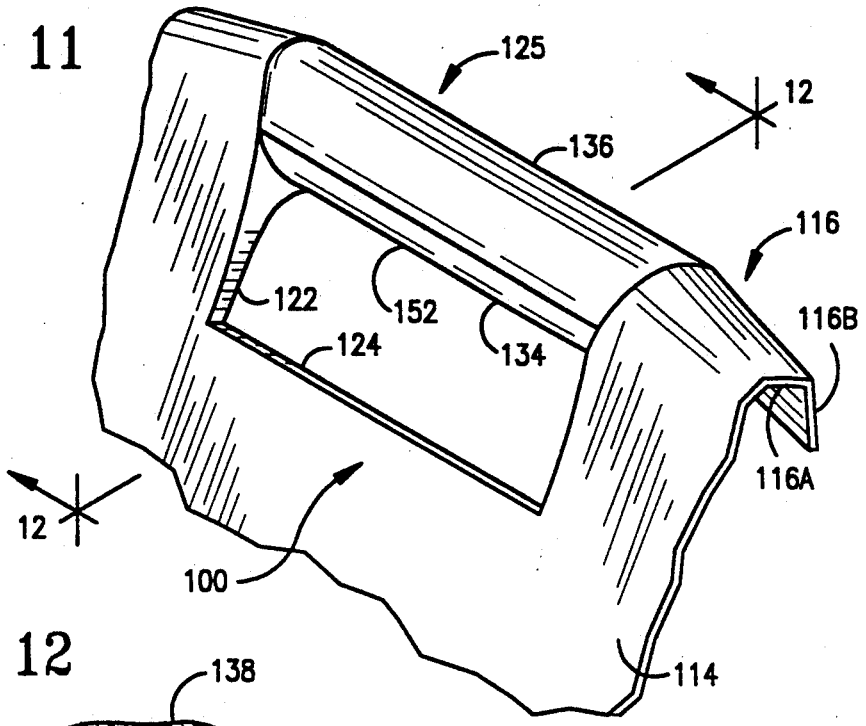
FIG. 11 is a perspective view of an alternate embodiment of a wall and rim of a laundry basket, including a handle, in accordance with the invention.

Preferred embodiments of a laundry basket and a handle assembly according to the invention are shown in the drawings and described hereinbelow. Referring to FIGS. 1 and 10, a laundry basket 10 having a rectangular configuration is shown. Other configurations, could alternatively be employed.

The laundry basket 10 includes a bottom wall 12 and a plurality of side walls 14. A peripheral rim 16 extends from the tops of the side walls. The rim 16 includes a generally horizontal portion 16A and a downwardly extending portion 16B. The downwardly extending portion 16B is in opposing relation to the exterior surfaces of the basket side walls 14. The generally horizontal rim portion preferably forms a slightly obtuse angle with the side walls 14, and is accordingly slightly upwardly inclined. This rim construction provides a safe exterior surface which functions as a flexible bumper in the event the basket contacts a door frame or other item. The relatively large width of the generally horizontal portion 16A of the rim, which is about one inch, provides superior strength.

The side walls 14 of the basket include a plurality of openings 20 (as shown in FIG. 10) distributed over substantial portions thereof, thereby providing good ventilation within the basket. Hand openings 22 are provided within two opposing walls of the basket. (If the basket is circular, the hand openings are positioned diagonally across from each other). Each hand opening is positioned adjacent to the horizontal portion 16A of the rim. They are preferably spaced about one half to three quarters of an inch from this portion of the rim. The horizontal portion of the rim has a width of about one inch.

A bead 24 is formed about three sides of each hand opening 22. A rib 26 extends between the exterior surface of the basket and the downwardly extending portion 16B of the rim at each side of the hand opening 22. The ribs 26 are formed integrally with the side walls 14 and both rim portions 16A, 16B, and provide greater strength near the hand openings, where strength is most needed. The basket is preferably molded from a relatively stiff material, as opposed to the soft polymeric materials commonly employed in molded laundry baskets. High density polyethylene may be successfully employed, and it is believed that polypropylene would also be acceptable.

An elongate opening 28 is formed in the rim 16 above each hand openings 22. A pair of opposing, elongate walls 30, 32 extend upwardly from the rim along two opposing sides of the openings 28. A pair of ribs 34 extends from the upper corner portions of the basket to facilitate unstacking of nested baskets.

Referring to FIGS. 2-9, handle members 36 are secured to opposing sides of the basket. Each handle member is molded from high density polyethylene or the like. The handle members extend about the rim 16 and adjoining side wall portions, and through the respective hand openings 22.

Each handle member includes a top portion 36A and a bottom portion 36B. The top portion 36A has a generally semicylindrical body 38 which is generally C-shaped in cross section. Two opposing, parallel end walls 40 extend generally perpendicularly from the inner surface of the body and include bottom surfaces which are adapted to flushly engage the upper surface of the rim 16. A pair of ribs 42 also extend from the inner surface of the body and add strength thereto. The ribs 42 are also adapted to flushly engage the upper surface of the rim.

The exterior surface of the top portion 36A is substantially uniformly curved. The outer edge portion 44 of the body 38 is stepped, and includes a tab 46 extending therefrom. The inner edge portion 48 of the body 38 is also stepped, but the step is located within the inner surface of the body rather than the exterior surface thereof. A recess 50 extends from this edge portion 48 and adjoins a centrally located rib 52. This rib 52 is adapted to flushly engage the upper surface of the rim 16.

Figure 3:
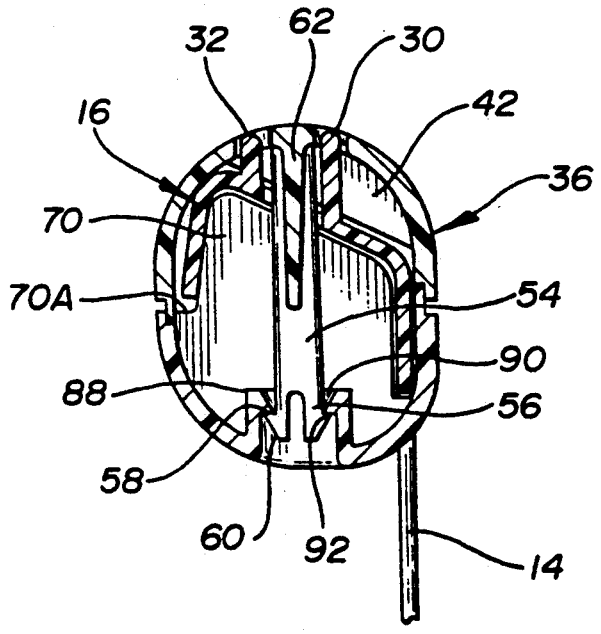
FIG. 3 is a sectional view taken along line 3—3 of FIG. 1.
Figure 6:
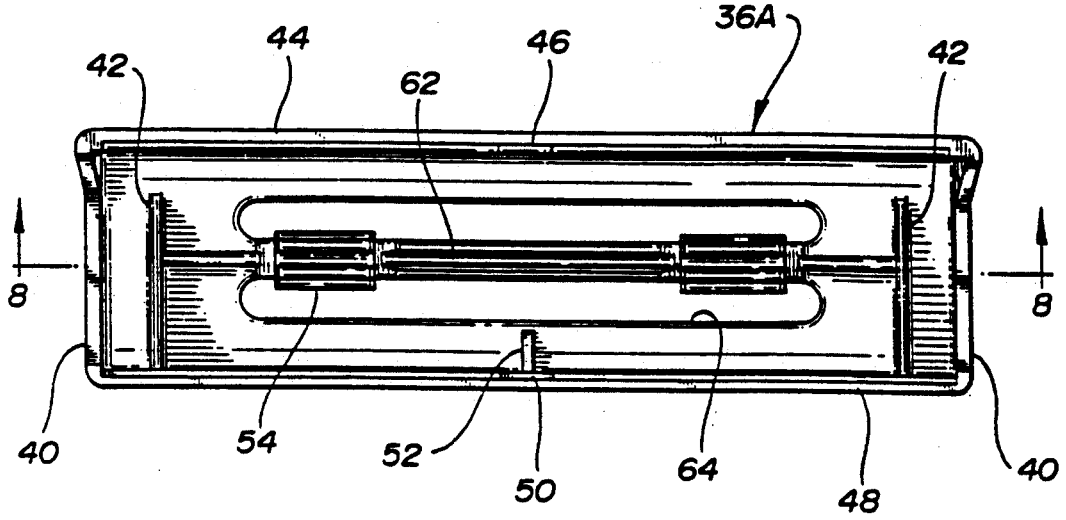
FIG. 6 is a bottom plan view of a top portion of a handle member according to the invention.
Figure 8:
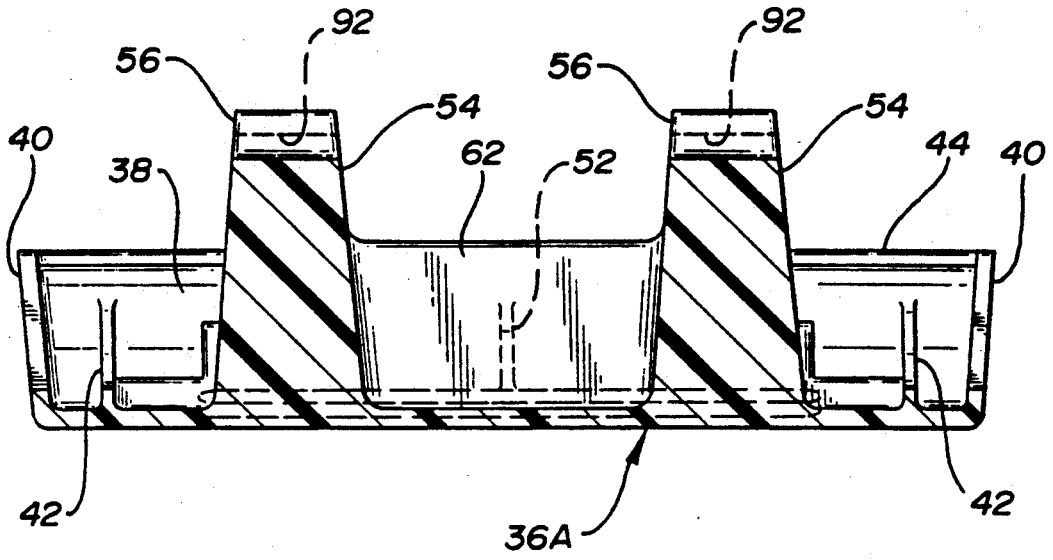
FIG. 8 is a sectional view taken along line 8—8 of FIG. 6.

First and second substantially identical protrusions 54 extend, respectively, from the inner surface of the body 38 of the top portion of the handle member 36. Each protrusion includes a bifurcated end 56 as shown in FIGS. 3, 6 and 8. Each half of the bifurcated end includes a shoulder 58 and a tapered end portion 60. A longitudinal wall 62 connects the two protrusions 54. Two elongate, parallel slots 64 are defined by the top portion of the longitudinal wall and the semicylindrical body 38. The slots 64 are adapted to receive the pairs of opposing walls 30, 32 extending upwardly from the rim 16.

The bottom portion 36B of the handle member 36 includes a generally semicylindrical body 66 which is generally C-shaped in cross section. A pair of end walls 68 extends from the inner surface of the body. Each end wall 68 includes top and side surfaces which correspond to the configuration of the rim 16 and adjoining side walls 14. A pair of ribs 70 having the same general configurations as the side walls also extends from the inner surface of the body 66.

A third, centrally positioned rib 72 having the same general configuration as the ribs 70 near the end walls 68 also extends from the inner surface of the body. This rib includes a slot 74 defined within its upper end.

The exterior surface of the bottom portion 36B of the handle member 36 is substantially uniformly curved. The inner edge portion 76 thereof is stepped, and includes an upwardly extending tab 78 which is adapted to fit within the recess 50 in the inner edge portion 48 of the top portion 36A of the handle member. The outer edge portion 80 of the body 66 is also stepped, but the step is defined within the inner surface thereof. A recess 82 extends from this edge portion 80. The recess 82 and edge portion 80 are adapted to receive the tab 46 and part of the edge portion 44 of the top portion 36A of the handle member 36, respectively.

Figure 2:
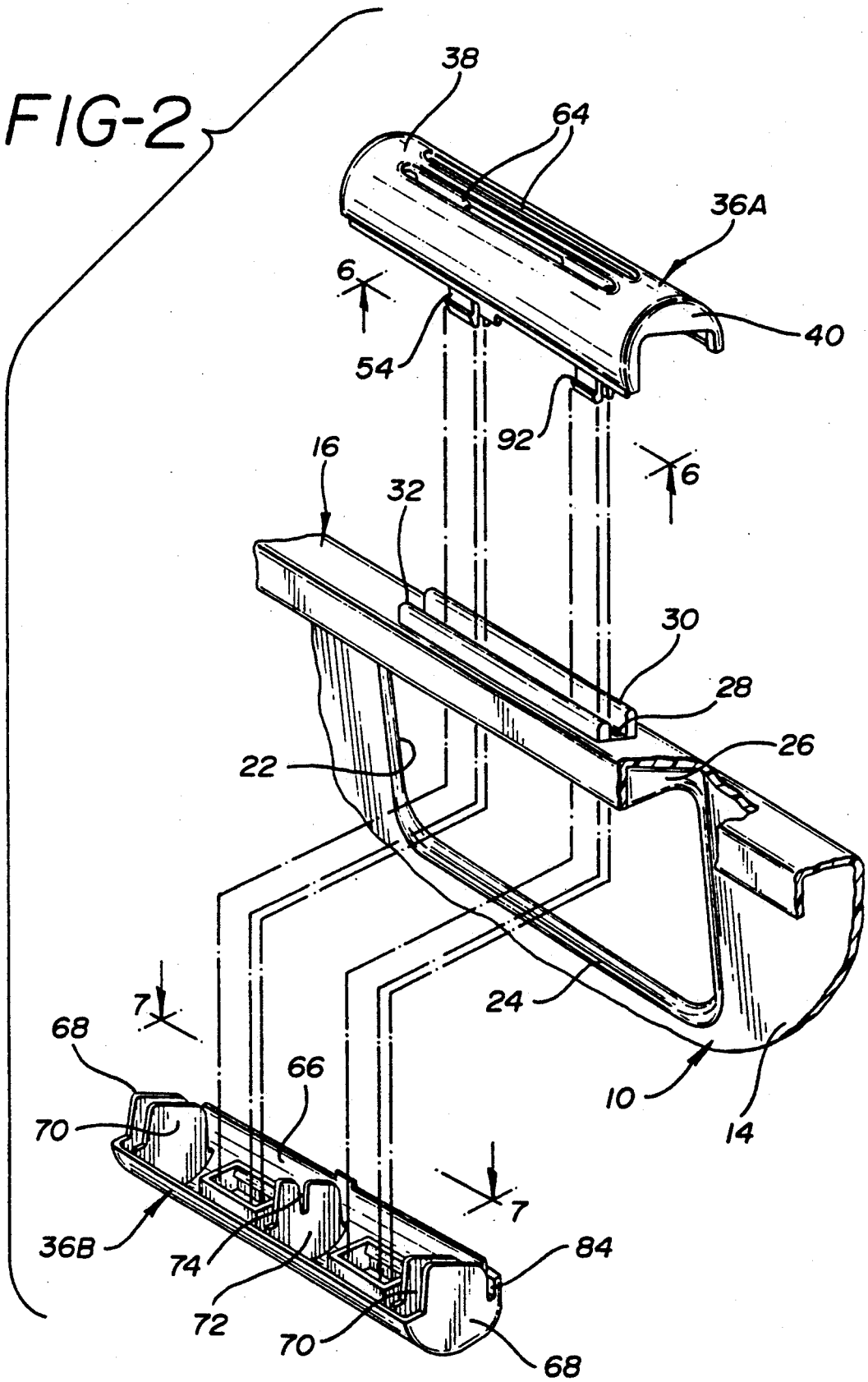
FIG. 2 is an exploded, perspective view thereof.
Figure 4:
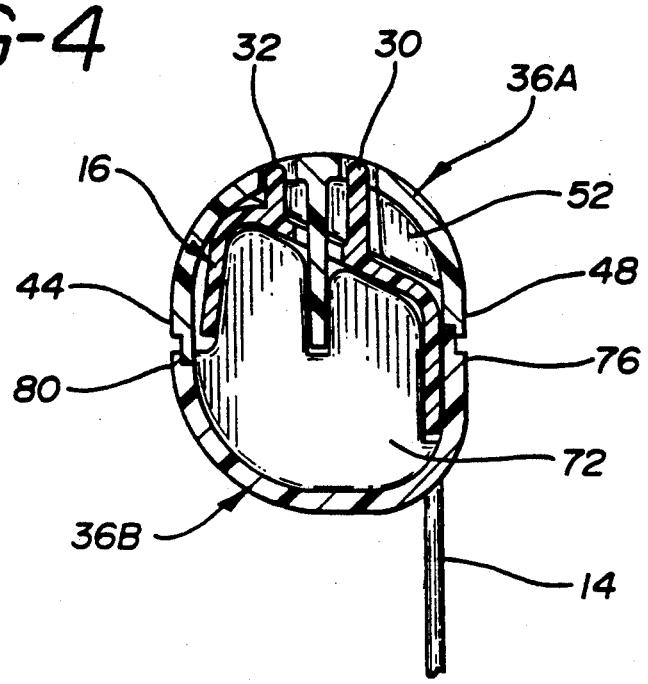
FIG. 4 is a sectional view taken along line 4—4 of FIG. 1.
Figure 5:
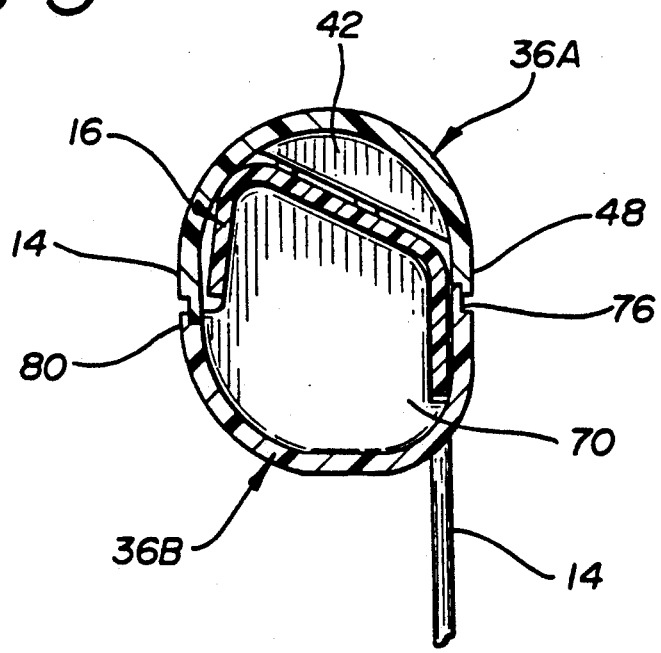
FIG. 5 is a sectional view taken along line 5—5 of FIG. 1.
Figure 7:
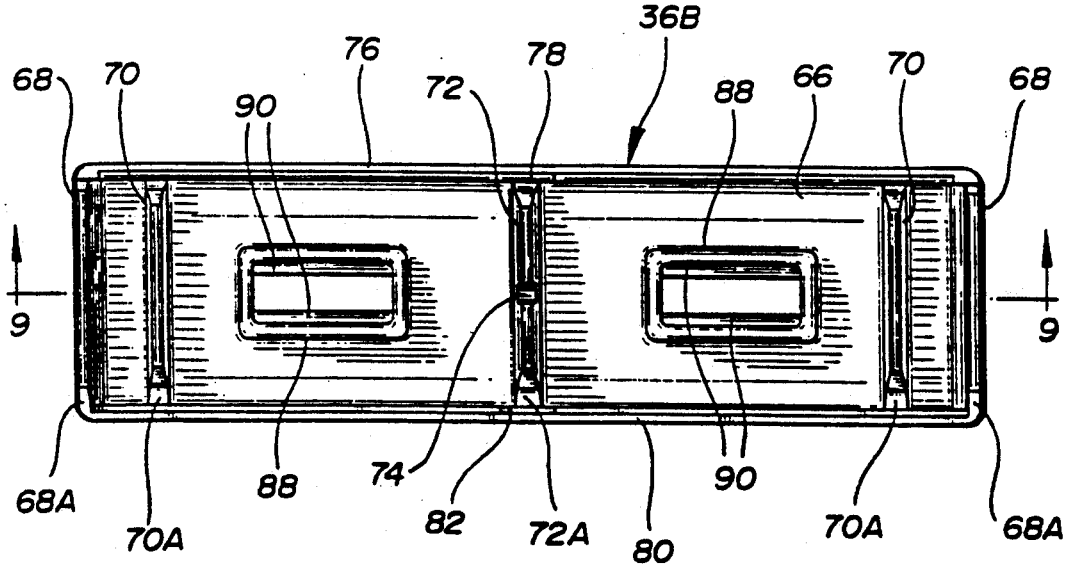
FIG. 7 is a top plan view of a bottom portion of a handle member according to the invention.

The end walls 68 and ribs 70, 72 extending laterally across the bottom portion 36B of the handle member 36 each adjoins the inner surface thereof near the outer edge portion 80 thereof, forming a plurality of coplanar shoulders 68A, 70A, 72A as shown in FIG. 7. The opposite sides of the end walls 68 and ribs 70, 72 are each positioned about an eighth of an inch from the inner edge portion 76 thereof. This arrangement provides a longitudinal slot 84 extending the length of the body 66, as shown in FIG. 2. The slot 84 is adapted to snugly receive the portion of the basket side wall 14 directly above either hand opening 22.

Figure 9:
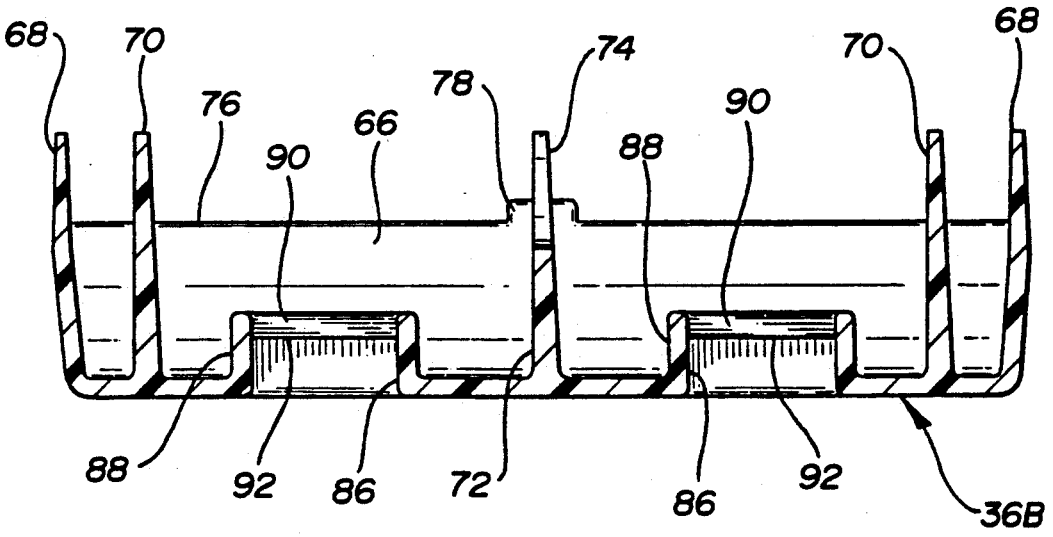
FIG. 9 is a sectional view taken along line 9—9 of FIG. 7.

A pair of rectangular openings 86 is defined in the lower surface of the bottom portion 36B of the handle member. A pair of rectangular tubes 88 extends upwardly from the interior surface of the body 66 and adjoins the openings 86 as shown in FIG. 9. Each tube 88 includes a pair of opposing, converging upper surfaces 90 which terminate at a pair of coplanar shoulders 92. The tubes 88 are adapted to receive the protrusions 54 of the top portion 36A of the handle member. The pairs of converging surfaces 90 are adapted to compress the respective bifurcated ends 56 of the protrusions 54 until the shoulders 58 thereof clear the shoulders 92. The bifurcated ends then spring fully open again, locking the ends 56 of the protrusions 54 behind the shoulders 92. The top and bottom portions of the handle member can thereby be permanently locked to each other and to the rim 16.

The constructions of the basket 10 and handle members 36 allow these molded components to be assembled to each other. The top portions 36A of the handle members are positioned above the hand openings 22 and urged downwardly until the protrusions 54 are fully inserted within the elongate openings 28. The basket is placed in an inverted position upon a fixture which supports the top handle portions 36A. The bottom portions 36B of the handle members are then positioned over the respective top portions and urged downwardly. The slots 74 in the centrally located ribs 72 receive the walls 62 connecting the respective sets of protrusions 54, and guide the bottom portions 36B as they are urged towards the rim 16. The series of shoulders 68A, 70A, 72A engage the bottom surface of the downwardly extending rim portions 16B. The upper surfaces of the end walls 68 and ribs 70, 72 flushly engage the lower surface of the generally horizontal rim portion 16A. Finally, the elongate slots 84 receive the side wall portions 14 above the respective hand openings 22.

The bifurcated ends 56 of the protrusions 54 of each top portion 36A are locked behind the shoulders 92 formed within the rectangular tubes 88. The tabs 46, 78 are simultaneously received in the respective recesses 82, 50. When locked in position, the bottom surfaces of the end walls 40 and ribs 42, 52 flushly engage the top surface of the rim 16. The opposing sides of the top portion 36A flushly engage the exterior surface of the downwardly extending portion 16B of the rim and an interior surface of one of the side walls 14, respectively. Finally, the upper surfaces of walls 30, 32 are substantially flush with the upper surface of the handle member 36.

The handle construction described above may be readily adapted to round or elliptical baskets or those having rims which are arcuate in cross section. The locking members of the top and bottom portions may also be reversed. Used with any type of rimmed basket, the handle members provide a large round surface which facilitates a comfortable grip by the user. Once snapped together, the two pieces comprising each handle member form an integral part of the basket.

One or both handle members may alternatively be formed as integral, molded parts of the basket itself. A preferred embodiment of such a laundry basket wherein one handle member is formed as an integral molded part of the basket itself may be seen by referring to FIGS. 11 through 15, wherein a laundry basket 100 having a rectangular configuration is shown. Again, other configurations, could alternatively be employed.

The laundry basket 100 includes a bottom wall 112 and a plurality of side walls 114. A peripheral rim 116 extends from the tops of the side walls. The rim 116 includes a generally horizontal portion 116A and a downwardly extending portion 116B. The downwardly extending portion 116B is in opposing relation to the exterior surfaces of the basket side walls 114. The generally horizontal rim portion preferably forms a slightly obtuse angle with the side walls 114, and is accordingly slightly upwardly inclined. This rim construction provides a safe exterior surface which functions as a flexible bumper in the event the basket contacts a door frame or other item. The relatively large width of the generally horizontal portion 116A of the rim, which is about 0.75 inches, provides superior strength.

Figure 15:
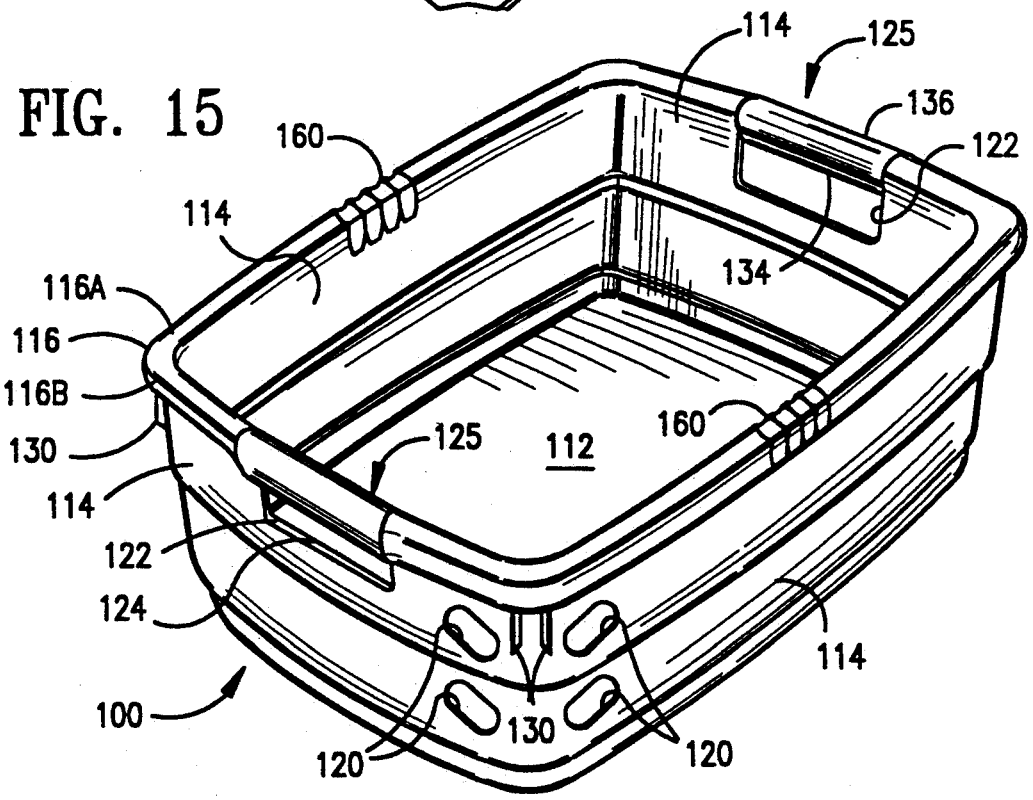
FIG. 15 is a top perspective view of the FIG. 11 laundry basket embodiment, in accordance with the invention.

The side walls 114 of the basket include a plurality of openings 120 (as shown in FIG. 15) distributed over substantial portions thereof, thereby providing good ventilation within the basket. Hand openings 122 are provided within two opposing walls of the basket. (If the basket is circular, the hand openings are positioned diagonally across from each other). Each hand opening is positioned adjacent to the horizontal portion 116A of the rim. They are preferably spaced about one half to three quarters or an inch from this portion of the rim. The horizontal portion of the rim has a width of about one inch. In a preferred embodiment, hand grips 160 are provided on portions of rim 116 on sides adjacent from the sides having handle members 125 to enhance the utility of basket 100. A pair of ribs 130 extends from the upper corner portions of the basket to facilitate unstacking of nested baskets. A bead 124 is formed about three sides of each hand opening 122.

As indicated above, the basket is preferably molded from a relatively stiff material, as opposed to the soft polymeric materials commonly employed in molded laundry baskets. High density polyethylene is preferred, while polypropylene would also be expected to be entirely acceptable.

Figure 12:
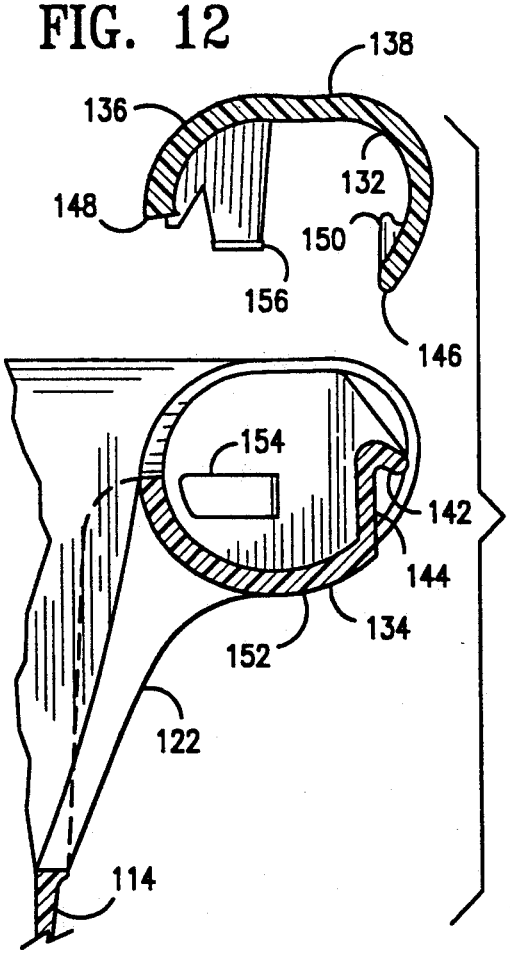
FIG. 12 is an exploded, sectional view taken along line 12—12 of FIG. 11.
Figure 13:
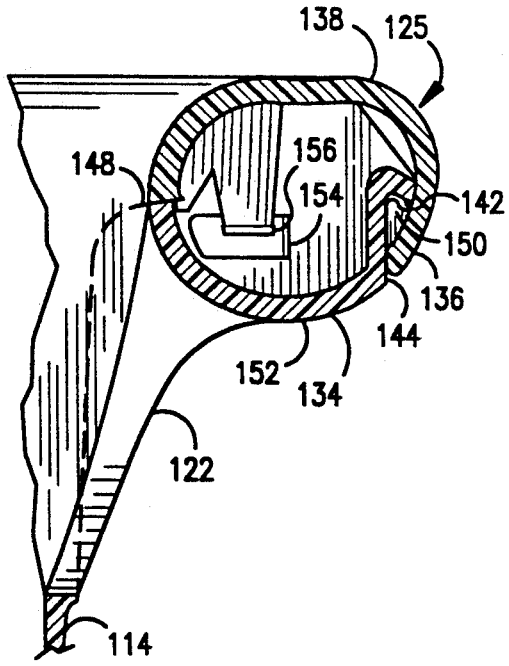
FIG. 13 is a sectional view taken along line 12—12 of FIG. 11.
Figure 14:
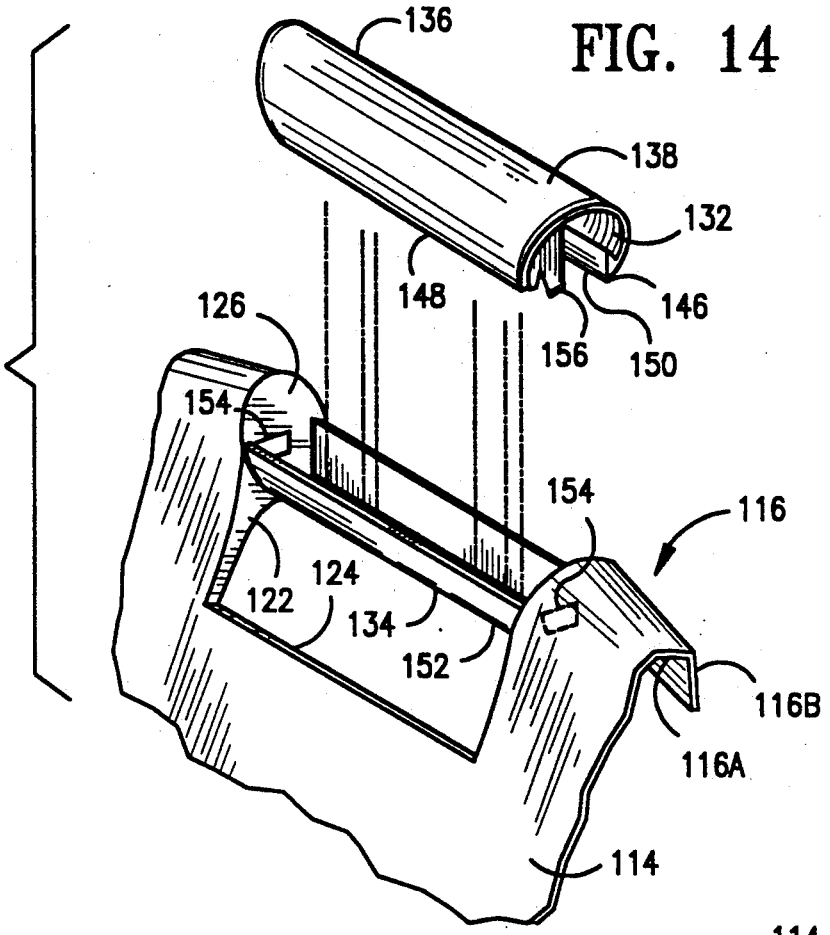
FIG. 14 is an exploded, perspective view of the embodiment depicted in FIG. 11.

Reference is now made to FIGS. 12-14 for details of a particularly preferred handle member 125. Again, the handle members 125 are molded from high density polyethylene or the like. The handle members 125 extend about the rim 116 and adjoining side wall portions 114, and through the respective hand openings 122.

Each handle member 125 includes a bottom portion 134 and a top portion 136. As is preferred from the standpoint of manufacturing economics, either the bottom or top portion of each handle member 125 is integrally molded to the peripheral rim 116 of basket 100. It is particularly preferred that bottom portion 134 be integrally molded to peripheral rim 116. As may be seen, top portion 136 has a generally semicylindrical body 138 which is generally C-shaped in cross section, As is preferred, the exterior surfaces of the bottom portion 134 and top portion 136 are substantially uniformly curved. Additionally, the bottom portion 134 of the handle member 125 includes a generally semicylindrical body 152 which is generally C-shaped in cross section.

Still referring to FIGS. 12–14, bottom portion 134, which is integrally formed as is most preferred, terminates in an outwardly protruding lip 142, lip 142 being integrally formed and connected to a substantially flat section 144. As may be appreciated, lip 142 may extend across the entire length of bottom portion 134 or across a substantial portion of its length or, as is preferred, may be interrupted at about the center of bottom portion 134, in essence forming a pair of lips 142 at the outermost ends of bottom portion 142. As indicated, outwardly protruding lip 142 is substantially parallel to the longitudinal axis of bottom portion 134, lip 142 forming a first hook-like member, Top portion 136 has a first longitudinal end 146 and a second longitudinal end 148, first longitudinal end 146 having at least one second hook-like member 150 integrally formed and connected thereto. As may be seen by reference to FIG. 13, second hook-like member 150 is configured to lockingly engage with the first hook-like member formed by lip 142 so as to lockingly join the top portion 136 to bottom portion 134 for each handle member 125.

As shown in FIG. 14, at opposite ends of each bottom portion 134, ribs 126 extend between the exterior surface of the basket and the downwardly extending portion 116B of the rim at each side of the hand opening 122. The ribs 126 are formed integrally with each bottom portion 134 and with the side walls 114 and both rim portions 116A, 116B, and serve to provide greater strength near the hand openings, where strength is most needed. Each rib 126 is provided with an orifice 154.

To further enhance the ability of top portion 136 to lockingly join to bottom portion 134, two opposing end walls 140 are provided which extend generally perpendicularly from inner surface 132 of the body 138. As shown in FIG. 14, end walls 140 each terminate in a hook 156. Hook 156 is configured so as to cooperate with orifice 154 of rib 126 to matingly engage with orifice 154 and enhance the ability of top portion 136 to lockingly join to bottom portion 134. As is preferred, end walls 140 are integral to the interior surface 132 of top portion 136.

The configuration of the basket 100 and top portions 136 allow these molded components to be assembled to each other. The top portions 136 of the handle members 125 are positioned above the hand openings 122 and urged downwardly until interlocking of the top portions 136 and bottom portions 134 occurs. When locked in position, the opposing sides of the top portion 136 substantially flushly engage the exterior surface of the downwardly extending portion 116B of the rim and an interior surface of one of the side walls 114, respectively.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A laundry basket, comprising:

(a) a walled container having a peripheral rim about a substantial portion thereof;

(b) a pair of opposing hand openings adjacent said peripheral rim; and (c) a pair of handle members extending, respectively, about said rim and through said hand openings, each of said handle members including a bottom portion positioned below said rim, said bottom portion having a first end and a second end, said bottom portion defining an upper boundary of one of said hand openings, said bottom portion further including a first rib at said first end and a second rib at said second end, said first and said second ribs each having an orifice therethrough, and a top portion, said top portion of said handle members including a curved exterior surface and an interior surface, said top portion being generally semicylindrical having a longitudinal axis therethrough, said top portion having a first longitudinal end and a second longitudinal end, wherein each said top portion of said handle members further includes two opposing end walls extending generally perpendicularly from said interior surface of said top portion, each of said end walls terminating in a hook configured to cooperate with said orifice of said rib of said bottom portion to matingly engaging with said orifice when lockingly joining said top portion to said bottom portion;

wherein one of said top or bottom portions of each of said handle members is integrally formed to said peripheral rim.

2. The laundry basket of claim 1, wherein each said bottom portion of said handle members is integrally formed to and positioned below said peripheral rim.

3. The laundry basket of claim 2, wherein each said integral bottom portion of said handle members includes a curved exterior surface.

4. The laundry basket of claim 3, wherein each said integral bottom portion of said handle members is in the form of a generally semicylindrical shell having a longitudinal axis.

5. The laundry basket of claim 4, wherein each said integral bottom portion of said handle members terminates in an outwardly protruding lip substantially parallel to said longitudinal axis, said outwardly protruding lip forming a first hook-like member.

6. The laundry basket of claim 5, wherein each said top portion of said handle members includes at said first longitudinal end a second hook-like member, said second hook-like member configured to lockingly engage with said first hook-like member of said bottom handle portion so as to lockingly join said top portions of said handle members to said bottom portions of said handle members.

7. The laundry basket of claim 2, wherein said peripheral rim includes a generally horizontal portion and a downwardly extending portion opposing the exterior surface of said walled container, said bottom portions of said handle members each being positioned at least partially between the downwardly extending portion of the rim and the exterior surface of said walled container.

8. A handle assembly for a rimmed container such as a laundry basket or the like, comprising:

(a) a bottom portion integrally formed to the rimmed container having an elongate, at least generally semicylindrical body said bottom portion having a longitudinal axis and a first end and a second end, said bottom portion further including a first rib at said first end and a second rib at said second end, said first and said second ribs each having an orifice therethrough;

(b) a top portion having an elongate, at least generally semicylindrical body, said top portion further including two opposing end walls extending generally perpendicularly from said top portion, each of said end walls terminating in a hook configured to cooperate with said orifice of said rib of said bottom portion to matingly engaging with said orifice when said top portion is lockingly joined to said bottom portion; and (c) interlocking means for locking said top portion to said integral bottom portion;

wherein said top portion is configured to engage the bottom portion.

9. The handle assembly of claim 8, wherein said integral bottom portion terminates in an outwardly protruding lip substantially parallel to said longitudinal axis, said outwardly protruding lip forming a first hook-like locking member.

10. The handle assembly of claim 9, wherein said top portion is of a generally C-shaped cross-sectional configuration having a first longitudinal end and a second longitudinal end, said first longitudinal end having a second hook-like locking member, said second hook-like locking member configured to lockingly engage with said first hook-like locking member of said integral bottom portion so as to lockingly join said bottom portion to said top portion, said first and second hook-like locking members comprising said interlocking means.

11. A molded thermoplastic laundry basket comprising:

(a) a walled container including a peripheral rim, said rim including a generally horizontal portion;

(b) a hand opening extending through a wall of said container and adjacent to said rim;

(c) a handle member extending about said rim, said handle member including a curved exterior surface defining an upper boundary of said hand opening; and (d) means for securing said handle member to said basket, said means for securing said handle member to said rim includes a bottom handle member portion having a first end and a second end, said bottom handle member portion terminating in an outwardly protruding lip, said outwardly protruding lip forming a first hook-like locking member, and a top handle member portion, said top handle member portion having a generally C-shaped cross-sectional configuration having a first longitudinal end and a second longitudinal end, said first longitudinal end having a second hook-like locking member, said second hook-like locking member configured to lockingly engage said first hook-like locking member of said bottom handle member portion so as to lockingly join said bottom handle member portion to said top handle member portion, said first and second hook-like locking members comprising said securing means, said bottom handle member portion further including a first rib at said first end and a second rib at said second end, said first and said second ribs each having an orifice therethrough.

12. The thermoplastic laundry basket of claim 11, wherein said rim includes a downwardly extending portion in opposing relation to the walls of said container, said handle member positioned at least partially between the downwardly extending portion of said rim and the outer surface of said walled container.

13. The thermoplastic laundry of claim 12, wherein said top handle member portion further includes two opposing end walls extending generally perpendicularly from said top handle member portion, each of said end walls terminating in a hook configured to cooperate with said orifice of said rib of said bottom handle member portion to matingly engaging with said orifice when said top handle member portion is lockingly joined to said bottom handle member portion.

* * * * *